US007863970B2

(12) United States Patent
Uchida et al.

(10) Patent No.: US 7,863,970 B2
(45) Date of Patent: Jan. 4, 2011

(54) CURRENT SOURCE DEVICE

(75) Inventors: Hirofumi Uchida, Tokyo (JP); Takashi Honda, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 163 days.

(21) Appl. No.: 12/180,740

(22) Filed: Jul. 28, 2008

(65) Prior Publication Data

US 2009/0091359 A1 Apr. 9, 2009

(30) Foreign Application Priority Data

Oct. 4, 2007 (JP) ..... 2007-260811

(51) Int. Cl.
*G05F 1/10* (2006.01)
*G05F 3/02* (2006.01)

(52) U.S. Cl. ..... 327/543; 327/108

(58) Field of Classification Search ..... 327/541, 327/543, 108, 540; 345/76, 204
See application file for complete search history.

(56) References Cited

U.S. PATENT DOCUMENTS 6,297,688 B1 * 10/2001 Nakamura ..... 327/538
6,774,572 B2 8/2004 Fukuzako
6,897,619 B2 * 5/2005 Shimizu ..... 315/169.3
6,922,182 B2 * 7/2005 Sase ..... 345/76
2006/0145966 A1 * 7/2006 Adachi ..... 345/76
2007/0211043 A1 * 9/2007 Furuichi ..... 345/204

FOREIGN PATENT DOCUMENTS

JP 2003131617 9/2003

* cited by examiner

*Primary Examiner*—Quan Tra
(74) *Attorney, Agent, or Firm*—Volentine & Whitt, P.L.L.C.

(57) ABSTRACT

A current source device having a plurality of current output circuits each including a current output FET, first and second switch FETs respectively series-connected to source and drain sides of the current output FET to form a series circuit, a source voltage supply which applies a positive-side potential of a source voltage to the first switch FET and applies a negative-side potential of the source voltage to the second switch FET to supply the source voltage to the series circuit, and an output terminal connected between the current output FET and the second switch FET; and a gate voltage supply circuit which supplies a common gate voltage to the gates of the current output FETs, wherein each of the current output circuits further includes a third switch FET provided between the current output FET and the second switch FET.

3 Claims, 10 Drawing Sheets

CURRENT SOURCE DEVICE

BACKGROUND OF THE INVENTION

The present invention relates to a current source device which is used in a semiconductor integrated circuit or the like and particularly suitable for the supply of light-emission drive currents to a plurality of light-emitting elements in an image display device in which the light-emitting elements are disposed and configured in matrix form.

FIG. 1 is a block diagram showing a schematic configuration of an image display device that uses general organic electroluminescence (hereinafter called "organic EL"). As shown in the same figure, n data lines $A_1$ through $A_n$ and m scan lines $B_1$ through $B_m$ arranged so as to intersect therewith are formed in a display panel 4. Organic EL elements $E_{1,1}$ through $E_{m,n}$ that assume pixels are formed at portions where the data lines and the scan lines intersect one another. That is, an image to be displayed is configured by light emission of the m×n organic EL elements formed on a display panel.

The scan lines $B_1$ through $B_m$ are connected to a scan line drive unit 2 including scan line switches $SWB_1$ through $SWB_m$. With the switching operations of the scan line switches, a ground potential or a predetermined positive potential VH (e.g., 10V) is applied to the respective scan lines. The scan line switches $SWB_1$ through $SWB_m$ sequentially apply the ground potential to the scan lines in accordance with a control signal supplied from a controller 1. Namely, the ground potential is sequentially applied to the scan lines at predetermined time intervals. Such periods are defined as scan line selection periods.

On the other hand, the data lines $A_1$ through $A_n$ are connected to a data line drive unit 3 including current sources $J_1$ through $J_n$ for generating drive currents to be supplied to the data lines, and data line switches $SWA_1$ through $SWA_n$. With the switching operations of the data line switches, the data lines are connected to either the current sources $J_1$ through $J_n$ or the ground potential. The data line switches $SWA_1$ through $SWA_n$ selectively connect the data lines $A_1$ through $A_n$ to the current sources in sync with the scan line selection periods in accordance with a control signal supplied from the controller 1. Of the organic EL elements on the scan lines selected by the scan line switches, those connected to the current sources by the data line switches are supplied with light-emission drive currents from the current sources and emit light at luminances corresponding to the light-emission drive currents.

In FIG. 1, for example, the scan line $B_1$ is selected by being connected to the ground potential by the scan line switch $SWB_1$, and the data lines $A_2$ and $A_3$ are connected to their corresponding current sources $J_2$ and $J_3$ by the data line switches $SWA_2$ and $SWA_3$. Thus, the organic EL elements $E_{1,2}$ and $EL_{1,3}$ provided at the portions where the scan line $B_1$ and the data lines $A_2$ and $A_3$ intersect, are respectively supplied with light-emission drive currents from the current sources $J_2$ and $J_3$ and emit light at luminances corresponding to the light-emission drive currents. All the scan lines $B_1$ through $B_m$ are sequentially selected within a predetermined frame period. In sync with it, light-emission drive currents corresponding to luminances are supplied to their corresponding organic EL elements, which in turn emit light thereby to form one screen.

FIG. 2 is an equivalent circuit diagram of a current source device that constitute the current sources $J_1$ through $J_n$ for supplying the light-emission drive currents to the respective organic EL elements via the data lines $A_1$ through $A_n$ in the above image display device. The current source device comprises a single gate voltage supply unit 10 and an output unit 20 comprising n current output circuits 30-1 through **30-*n*** respectively corresponding to the data lines $A_1$ through $A_n$.

The gate voltage supply unit 10 comprises an operational amplifier OP1, PMOS transistors P1 and P2 and a resistor R1. An inversion input terminal of the operational amplifier OP1 is supplied with a predetermined reference voltage V1. The output of the operational amplifier OP1 is connected to the gate of the PMOS transistor P2. The source of the PMOS transistor P2 is connected to the drain of the PMOS transistor P1, and the drain thereof is connected to the resistor R1 whose one end is fixed to a predetermined negative-side potential Vss. The potential of a connecting point of the PMOS transistor P2 and the resistor R1 is supplied to a non-inversion input terminal of the operational amplifier OP1. The gate of the PMOS transistor P1 is fixed to the negative-side potential Vss and a source voltage Vdd is applied to the source thereof. In the gate voltage supply unit 10 having such a configuration, the gate voltage of the PMOS transistor P2 is controlled by the output of the operational amplifier OP1, so that a reference current I1 corresponding to the reference voltage V1 flows through a current path routed through the PMOS transistors P1 and P2 and the resistor R1. Incidentally, since the PMOS transistor P1 has a predetermined on resistance while it is always in an ON state, the PMOS transistor P1 functions as a resistive element.

The output unit 20 comprises current output circuits 30-1 through **30-*n* corresponding to the data lines $A_1$ through $A_n$ as described above. The current output circuits 30-1 through 30-*n* respectively have the same configuration. In each of the current output circuits, a PMOS transistor P4 has a gate connected to a gate line of the PMOS transistor P2, i.e., an output line of the operational amplifier OP1 and functions as a current output FET for generating an output current to be supplied to the corresponding data line. That is, the gate of the PMOS transistor P4 is supplied with a common gate voltage in each current output circuit. The drain of the PMOS transistor P4 is connected to the drain of an NMOS transistor N1 and the source thereof is connected to the drain of a PMOS transistor P3. The source of the NMOS transistor N1 is fixed to the negative-side potential Vss and the gate thereof is supplied with a control signal NSW from a controller 1. Output terminals OUT1 through OUTn are provided at connecting points of the PMOS transistors P4 and the NMOS transistors N1, and the data lines $A_1$ through $A_n$ are connected to their corresponding output terminals OUT1 through OUTn. The source voltage Vdd is applied to the source of each PMOS transistor P3 and the gate thereof is supplied with a control signal PSW from the controller 1. By setting the dimensions (ratios W/L between gate widths and gate lengths) of the PMOS transistors P2 and P4 and the PMOS transistors P1 and P3 identical to each other in the current source device having such a configuration, output currents each indicative of the same current value as that of the reference current I1 can be obtained from the output terminals OUT1** through OUTn, whereby light-emission drive currents can be uniformly supplied to the data lines $A_1$ through $A_n$.

The PMOS transistors P3 and NMOS transistors N1 respectively correspond to the data line switches $SWA_1$ through $SWA_n$ that switch whether the output currents should be supplied to their corresponding data lines. When the gate of each PMOS transistor P3 is supplied with a control signal of a Low level and the gate of each NMOS transistor N1 is supplied with a control signal of a Low level, the PMOS transistor P3 is brought to an ON state and the NMOS transistor N1 is brought to an OFF state. Thus, the potential of the corresponding output terminal is brought to a High level so that the corresponding data line is supplied with a light-emission drive current. On the other hand, when the gate of the PMOS transistor P3 is supplied with a control signal of a High level and the gate of the NMOS transistor N1 is supplied with a control signal of a High level, the PMOS transistor P3 is brought to an OFF state and the NMOS transistor N1 is brought to an ON state. Thus, the potential of the corresponding output terminal is brought to a Low level so that the supply of current to the corresponding data line is stopped. That is, the PMOS transistor P3 and the NMOS transistor N1 respectively constitute a positive-side (high side) switch and a negative-side (low side) switch respectively connected to the electric source and the negative-side potential with the PMOS transistor P4 functioning as the current output FET being interposed therebetween. A switching current path is formed by switching ON/OFF of the supply of current to each data line by these high side and low side switches. ON/OFF control on the output currents of the current source device is done every current output circuits 30-1 through **30-*n***, and the supply of light-emission drive currents and their supply stop are controlled every data line.

The current source device used in the organic EL image display device having the above-described configuration has been described in, for example, a patent document 1 (Japanese Unexamined Patent Publication No. 2003-131617).

FIG. 3 shows operation waveforms of the respective parts in the current source device having the above-described conventional configuration at the time that the supply of an output current is caused to continue at the nth current output circuit **30-*n* from a state in which all the current source circuits 30-1 through 30-*n* supply output currents to the respective data lines, and the current supply is transitioned to its stop state at the 1st through n−1th current output circuits other than the above. In such a case, the control signals PSW and NSW are both switched from a Low level to a High level with the timings provided to stop the supply of currents to the data lines at the 1st through n−1th current output circuits. On the other hand, the control signals PSW and NSW are maintained at the Low level at the nth current output circuit 30-*n* to maintain the current supply. Incidentally, the control on the input of such control signals PSW and NSW is conducted by the controller 1** based on image data.

Here, parasitic capacitances C1 respectively exist between the gates and drains of the PMOS transistors P4 of the current output circuits 30-1 through **30-*n*, and a combined capacitance as viewed from the output of the operational amplifier OP1** assumes n*C1. Namely, a large-capacity capacitor can be assumed to be connected to the output line of the operational amplifier OP1. When, in this case, the respective NMOS transistors N1 of the 1st through n−1th current output circuits are respectively brought to an ON state in unison according to the switching of the control signal NSW, a charging current flows through the parasitic capacitances C1 in unison. As the charge into each parasitic capacitance C1 takes place in a short period of time, the instantaneous value of the charging current increases. When the drive capacity of the operational amplifier OP1 is low, the potential of the output line of the operational amplifier OP1 is reduced primarily during a charging period as shown in FIG. 3. When the potential of the output line of the operational amplifier OP1 is reduced primarily, the gate voltage of the PMOS transistor P4 controlled to output a predetermined constant current is reduced at the current output circuit **30-*n*** to cause the current supply to continue. Therefore, a malfunction occurs in which the output current rises beyond a predetermined control value occurs. As a result, a problem arises in that the light-emission drive current increased due to the malfunction is temporarily supplied to each organic EL element connected to the data line An, thereby exerting an effect on light-emission luminance.

SUMMARY OF THE INVENTION

The present invention has been made in view of the foregoing points. It is an object of the present invention to provide a current source device comprising a plurality of current output circuits capable of performing ON/OFF control of output currents individually, which is capable of preventing malfunctions caused by switching the outputs of the large number of current output circuits in unison.

According to one aspect of the present invention, for attaining the above object, there is provided a current source device comprising a plurality of current output circuits each including a current output FET, first and second switch FETs respectively series-connected to source and drain sides of the current output FET to form a series circuit, source voltage supply means which applies a positive-side potential of a source voltage to the first switch FET and applies a negative-side potential of the source voltage to the second switch FET to supply the source voltage to the series circuit, and an output terminal connected between the current output FET and the second switch FET; and a gate voltage supply circuit which supplies a common gate voltage to the gates of the current output FETs, wherein each of the current output circuits further includes a third switch FET provided between the current output FET and the second switch FET.

According to the current source device of the present invention, including a plurality of current output circuits capable of performing ON/OFF control of output currents individually, it is capable of preventing malfunctions caused when the outputs of the large number of current output circuits are switched simultaneously.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE PREFERRED EMBODIMENTS

Figure 1:
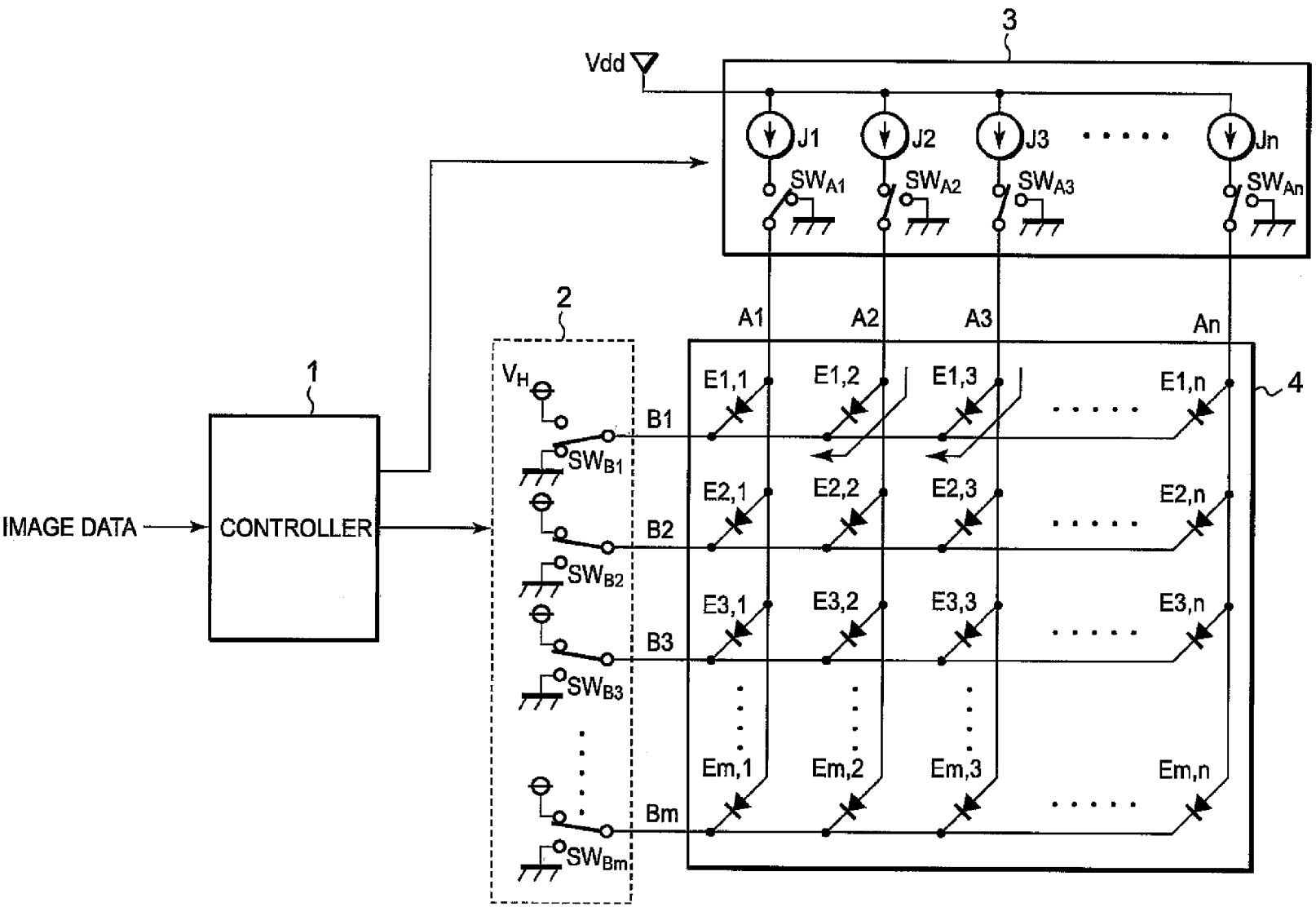
FIG. 1 is a block diagram showing an overall configuration of a conventional image display device using organic EL elements.

Preferred embodiments of the present invention will hereinafter be described with reference to the accompanying drawings. Constituent elements and parts substantially identical or equivalent in the drawings illustrated below are respectively given the same reference numerals.

First Preferred Embodiment

Figure 2:
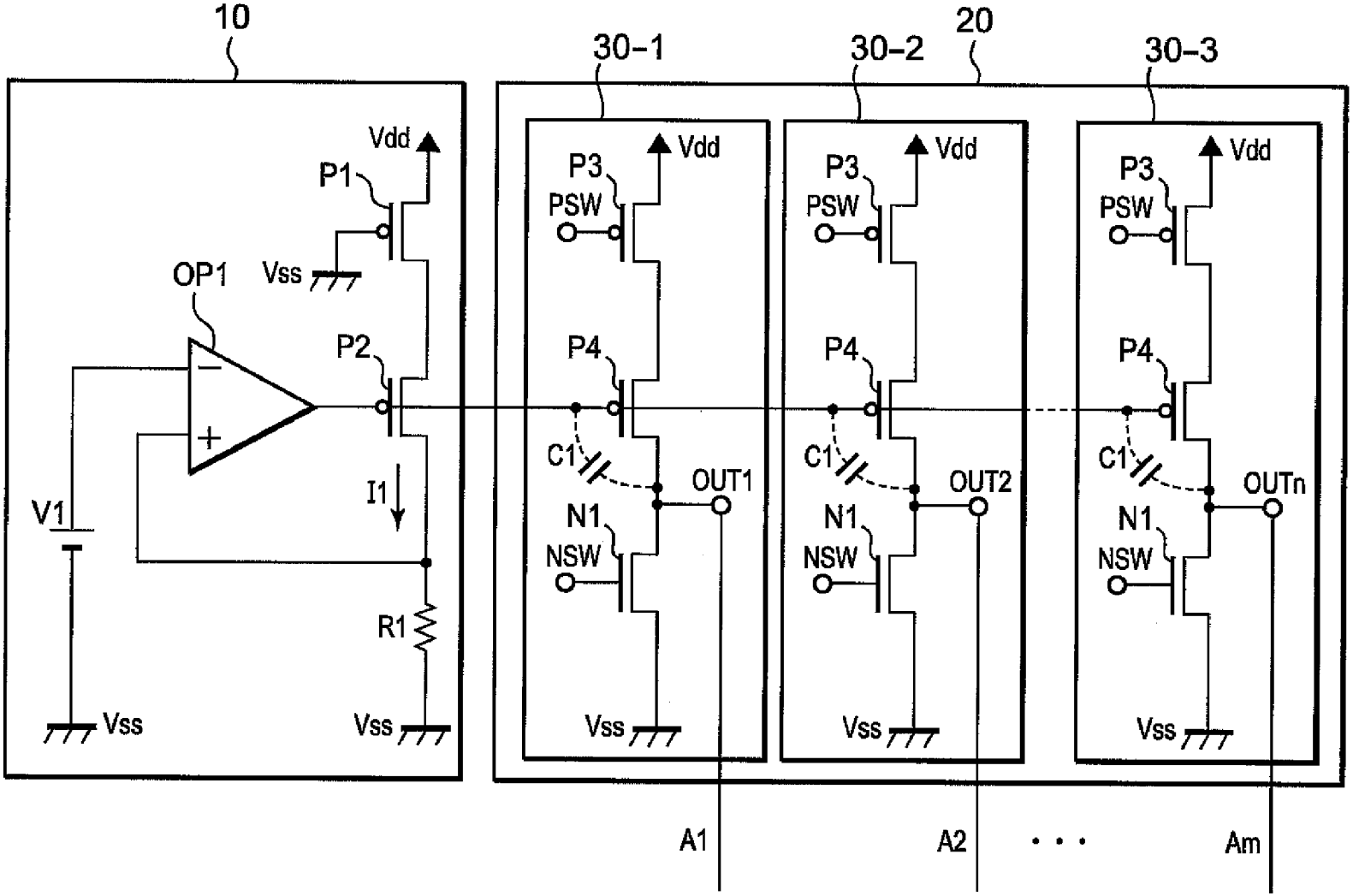
FIG. 2 is an equivalent circuit diagram illustrating a configuration of a conventional current source device.
Figure 4:
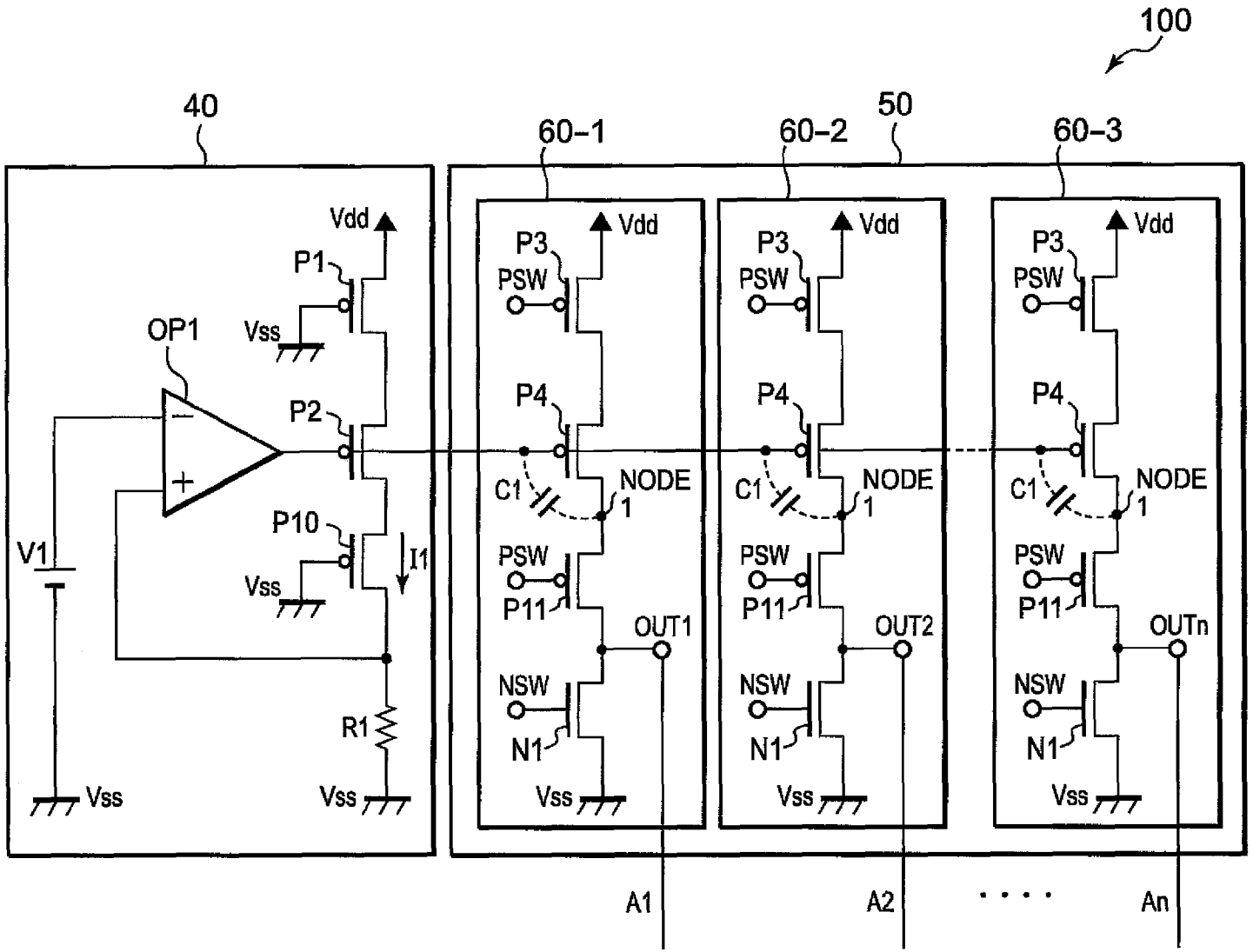
FIG. 4 is an equivalent circuit diagram showing a configuration of a current source device according to a first preferred embodiment of the present invention.

FIG. 4 is an equivalent circuit diagram showing a configuration of a current source device 100 according to a first preferred embodiment of the present invention. In FIG. 4, the same reference numerals are respectively attached to parts common to the configuration of the conventional current source device shown in FIG. 2. In a manner similar to one having the conventional configuration, the current source device 100 of the present invention comprises a single gate voltage supply unit 40 and an output unit 50 comprising n current output circuits 60-1 through **60-*n*** respectively corresponding to data lines $A_1$ through $A_n$.

The gate voltage supply unit 40 is different from one having the conventional configuration in that a PMOS transistor P10 is provided between a resistor R1 and a PMOS transistor P2. That is, the PMOS transistor P10 has a source connected to its corresponding drain of the PMOS transistor P2, a drain connected to the resistor R1 and a gate fixed to a negative-side potential Vss. A non-inversion input terminal of an operational amplifier OP1 is connected to a connecting point of the PMOS transistor P10 and the resistor R1. Since the PMOS transistor P10 is always held ON but has a predetermined on resistance in such a configuration, the PMOS transistor P10 functions as a resistive element. The PMOS transistor P10 is disposed in the above location to correspond to the addition of a PMOS transistor P11 to each current output circuit having the conventional configuration at each of current output circuits 60-1 through **60-*n* to be described later. This is done to cause each current output circuit to generate a mirror current indicative of the same current value as that of a reference current I1**.

In each of the current output circuits 60-1 through **60-*n*, a PMOS transistor P3 (first switch FET) is series-connected to the source side of a PMOS transistor P4 that functions as a current output FET. An NMOS transistor N1 (second switch FET) is connected to the drain side of the PMOS transistor P4 via a PMOS transistor P11 (third switch FET) to be described later. That is, the PMOS transistors P3, P4 and P11 and the NMOS transistor N1 constitute a series circuit. A source voltage Vdd is applied between both ends of the series circuit. The PMOS transistor P3 and the NMOS transistor N1 interposes the PMOS transistor P4 therebetween and respectively constitute a positive (high side) switch connected to the potential-side potential of the source voltage and a negative (low side) switch connected to the negative-side potential thereof. The PMOS transistor P11 is interposed between the PMOS transistor P4 and the NMOS transistor N1. Described specifically, the source of the PMOS transistor P11 is connected to the drain of the PMOS transistor P4, the drain thereof is connected to the drain of the NMOS transistor N1 and the gate thereof is supplied with a control signal PSW from a controller 1. A connecting point of the PMOS transistor P11 and the NMOS transistor N1** is configured as an output terminal of each current output circuit. The corresponding data lines $A_1$ through $A_n$ are connected to the respective output terminals. Incidentally, since component or constituent parts other than the above are similar to the conventional constituent parts, their explanations are omitted.

Figure 3:
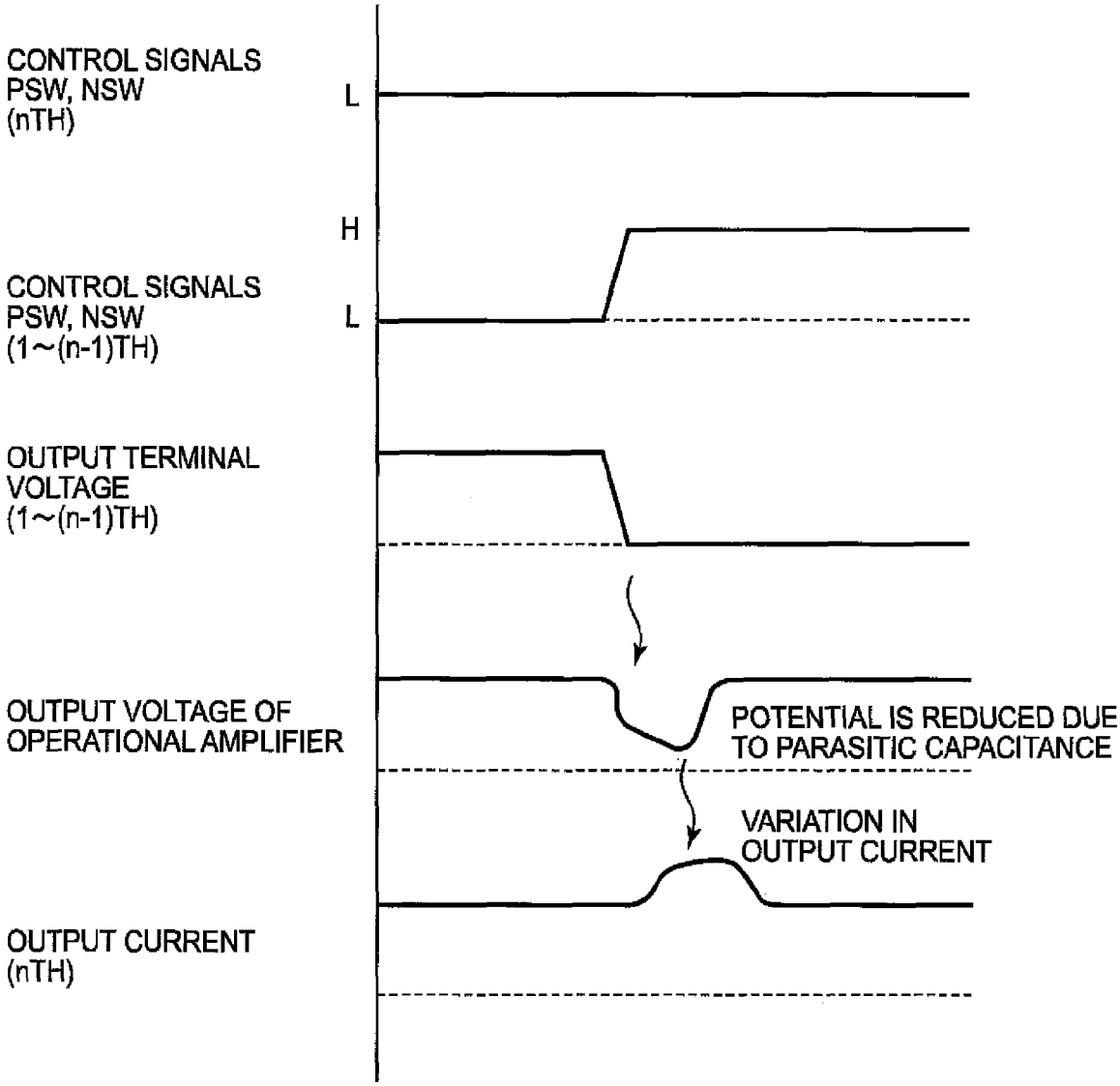
FIG. 3 is a diagram depicting operation waveforms of the conventional current source device.
Figure 5:
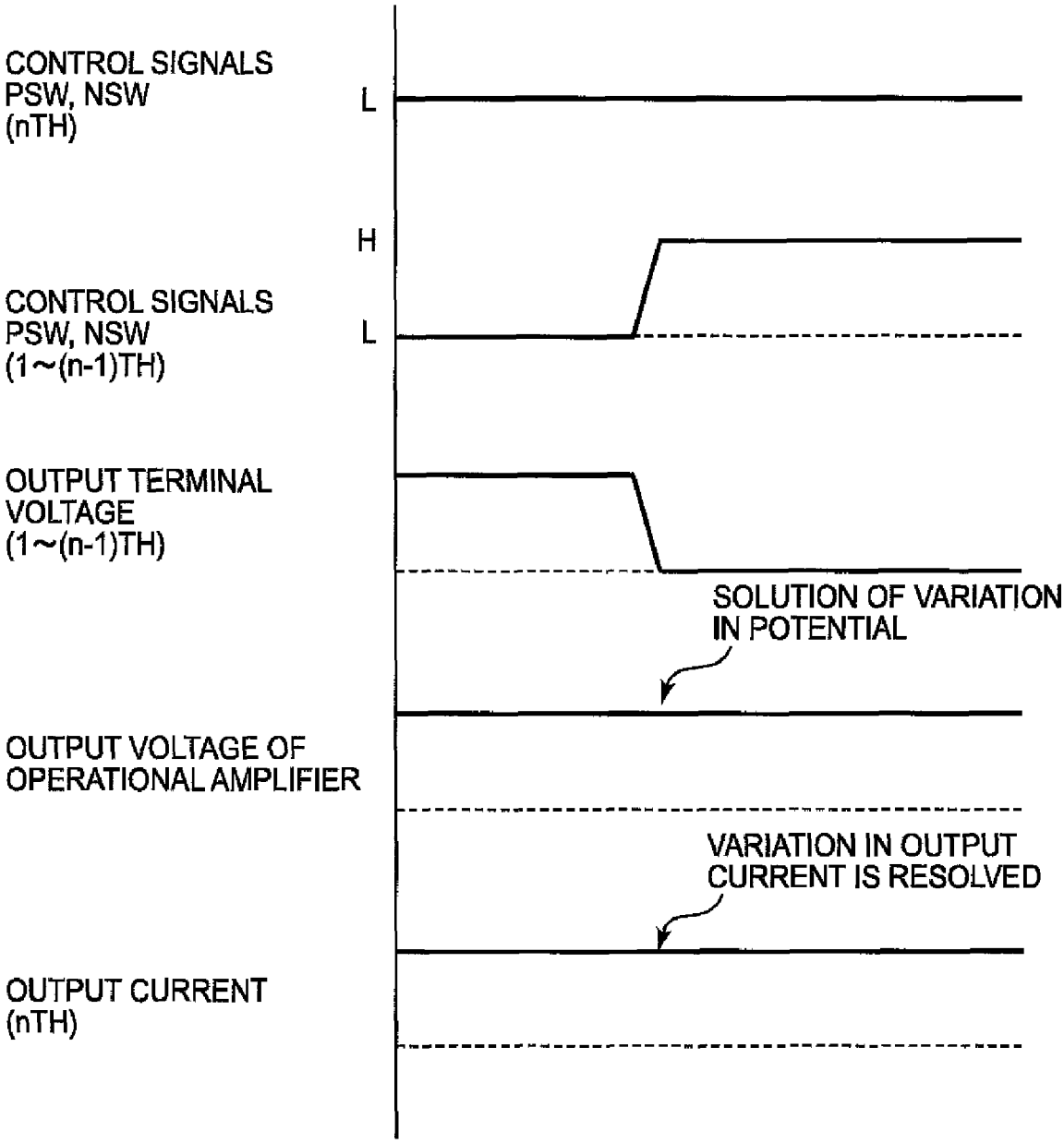
FIG. 5 is a diagram illustrating operation waveforms of the current source device of the present invention.

The operation of the current source device 100 according to the present invention will be explained below with reference to operation waveforms of respective parts, which are shown in FIG. 5. In a manner similar to the case shown in FIG. 3, FIG. 5 shows the operation waveforms of the respective parts at the time that the supply of output current is caused to continue from the state in which all the current source circuits 60-1 through **60-*n* supply output currents to their corresponding data lines, at the nth current output circuit 60-*n*, and the supply of current is transitioned to its stop state at the 1st through n−1th current output circuits other than the nth current output circuit. In this case, the control signals PSW and NSW are both switched from a Low level to a High level with the timing provided to stop the current supply at the 1st through n−1th current output circuits. On the other hand, the control signals PWS and NSW are maintained at the Low level at the nth current output circuit 60-*n* to maintain the current supply. Control on the input of the control signals PSW and NSW is done by the controller 1** based on image data.

During a period in which the control signals PSW and NSW are both of the Low level at the respective current output circuits 60-1 through **60-*n*, the PMOS transistors P3 and P11 are of an ON state, and the NMOS transistors N1 are of an OFF state. In this case, the output terminals of the current output circuits 60-1 through 60-*n*** are respectively of a High level and all the data lines $A_1$ through $A_n$ are supplied with their corresponding output currents.

When the control signals PSW and NSW are both switched from the Low level to the high level at the 1st through n−1th current output circuits, the PMOS transistors P3 and P11 are respectively brought to an OFF state and the NMOS transistor N1 is brought to an ON state. With the PMOS transistors P3 and P11 held in the OFF state, the supply of the output current is stopped. With the NMOS transistor N1 held in the ON state, the potential of the output terminal is brought to a Low level. Here, the conventional current source device has caused a malfunction in that since the NOMS transistors N1 and the PMOS transistors P4 are directly connected, the NMOS transistors N1 are driven to an ON state so that a charging current flows through respective parasitic capacitances C1 accompanying the PMOS transistors P4 of the 1st through n−1th current output circuits in unison, and the operational amplifier OP1 has a limit to its drive capacity, thereby causing the potential of an output line of the operational amplifier OP1 to be reduced momentarily. In the current source device 100 of the present invention in contrast to this, each of the PMOS transistors P11 is inserted between the PMOS transistor P4 and the NMOS transistor N1, and the PMOS transistor P11 is brought to the OFF state with the timing provided to bring the NMOS transistor N1 to the ON state, so that the PMOS transistor P4 and the NMOS transistor N1 are electrically isolated from each other. Thus, since the potential of the drain (node 1 in the figure) of each PMOS transistor P4 is maintained at the High level even though the NMOS transistor N1 is held in the ON state, no charge into each parasitic capacitance C1 does not occur and a variation in the potential of the output line of the operational amplifier OP1 is eliminated. Thus, the output current of the current output circuit **60-*n* to maintain the current supply does not vary either and a stable light-emission drive current can be supplied to the data line An. Incidentally, while the control signal PSW and the control signal NSW may be transitioned from the Low level to the High level simultaneously at the 1st through n−1th current output circuits, it may be feasible to first transition the control signal PSW to the High level and then transition the control signal NSW to the High level after the PMOS transistors P3 and P11 have been brought to the OFF state, and thereby bring the NMOS transistors N1** to the ON state.

Second Preferred Embodiment

The current source device 100 described in the first preferred embodiment is capable of resolving the malfunction that occurs when the 1st through n−1th current output circuits are respectively transitioned from the current supply state to the current supply stop state as described above. There is however a possibility that when the 1st through n−1th current output circuits held in the current supply stop state are respectively transitioned to the current supply state simultaneously again, a new malfunction will occur. This new malfunction will be explained with reference to FIG. 6. Incidentally, the current supply is assumed continuous at the nth current output circuit.

At the 1st through n−1th current output circuits, the control signals PSW and NSW are both switched from a High level to a Low level with the timing provided to start the current supply. On the other hand, the control signals PSW and NSW are maintained at the Low level at the nth current output circuit 60-*n* to maintain the current supply. With the switching of both the control signals PSW and NSW from the High level to the Low level at the 1st through n−1th current output circuits, the PMOS transistors P3 and P11 are respectively brought to an ON state and the NMOS transistors N1 are brought to an OFF state. Thus, the data lines $A_1$ through $A_{n-1}$, corresponding to the current output circuits are supplied with their corresponding output currents and thereby the potentials of the output terminals are respectively brought to a High level. Here, the potential of the drain (node 1 in the figure) of the PMOS transistor P4 is temporarily reduced at the moment that the PMOS transistor P11 is turned ON at each of the 1st through n−1th current output circuits. When a charging current flows through each parasitic capacitance C1 due to such a variation in the potential of the node 1, the output line of the operational amplifier OP1 is reduced in potential. In doing so, the voltage of the gate of the PMOS transistor P4 controlled to output a predetermined constant current is reduced at the current output circuit 60-*n* to cause the current supply to continue. Therefore, a malfunction occurs in that each output current rises beyond a predetermined control value in a manner similar to the above-described case.

Figure 7:
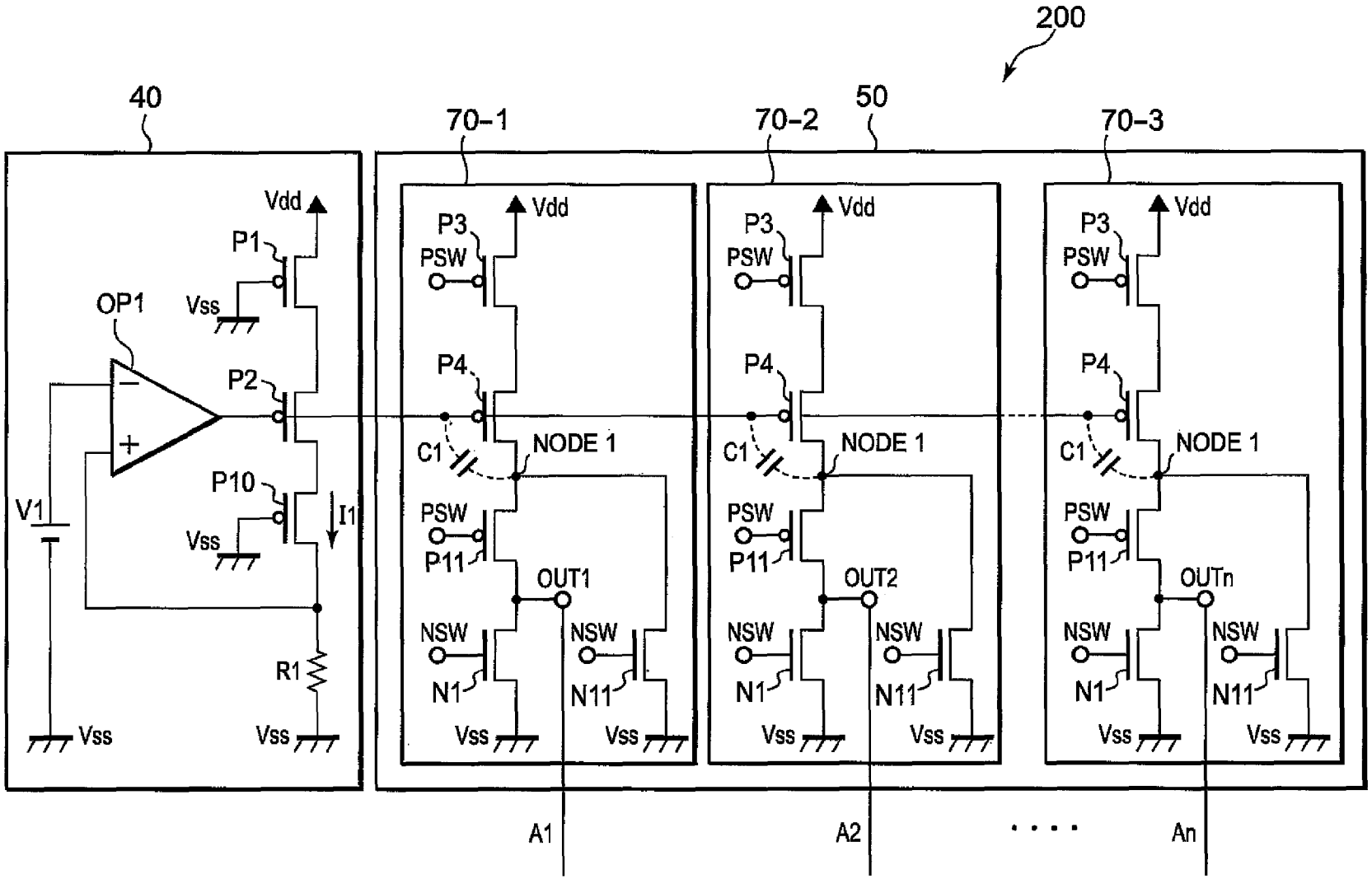
FIG. 7 is an equivalent circuit diagram showing a configuration of a current source device according to a second preferred embodiment of the present invention.

A current source device according to the second preferred embodiment is capable of resolving the above malfunction. FIG. 7 shows the current source device 200 according to the second preferred embodiment of the present invention. The current source device 200 according to the present embodiment is provided with potential fixing NMOS transistors N11 at the respective current output circuits 60-1 through 60-*n* in addition to the configuration of the current source device 100 according to the first preferred embodiment. That is, at each of current output circuits 70-1 through 70-*n*, the drain of the NMOS transistor N11 is connected to the node 1 shown in the figure, i.e., the drain of the PMOS transistor P4, the source thereof is connected to the negative-side potential Vss, and the gate thereof is supplied with a control signal NSW1 from the corresponding controller 1. The NMOS transistor N11 makes use of one in which its dimension (ratio W/L between its gate width and gate length) is sufficiently reduced thereby to make its switching speed slower than that of the NMOS transistor N1. The current source device 200 is identical in configuration to the current source device 100 according to the first preferred embodiment except that the NMOS transistors N11 are added thereto.

Figure 6:
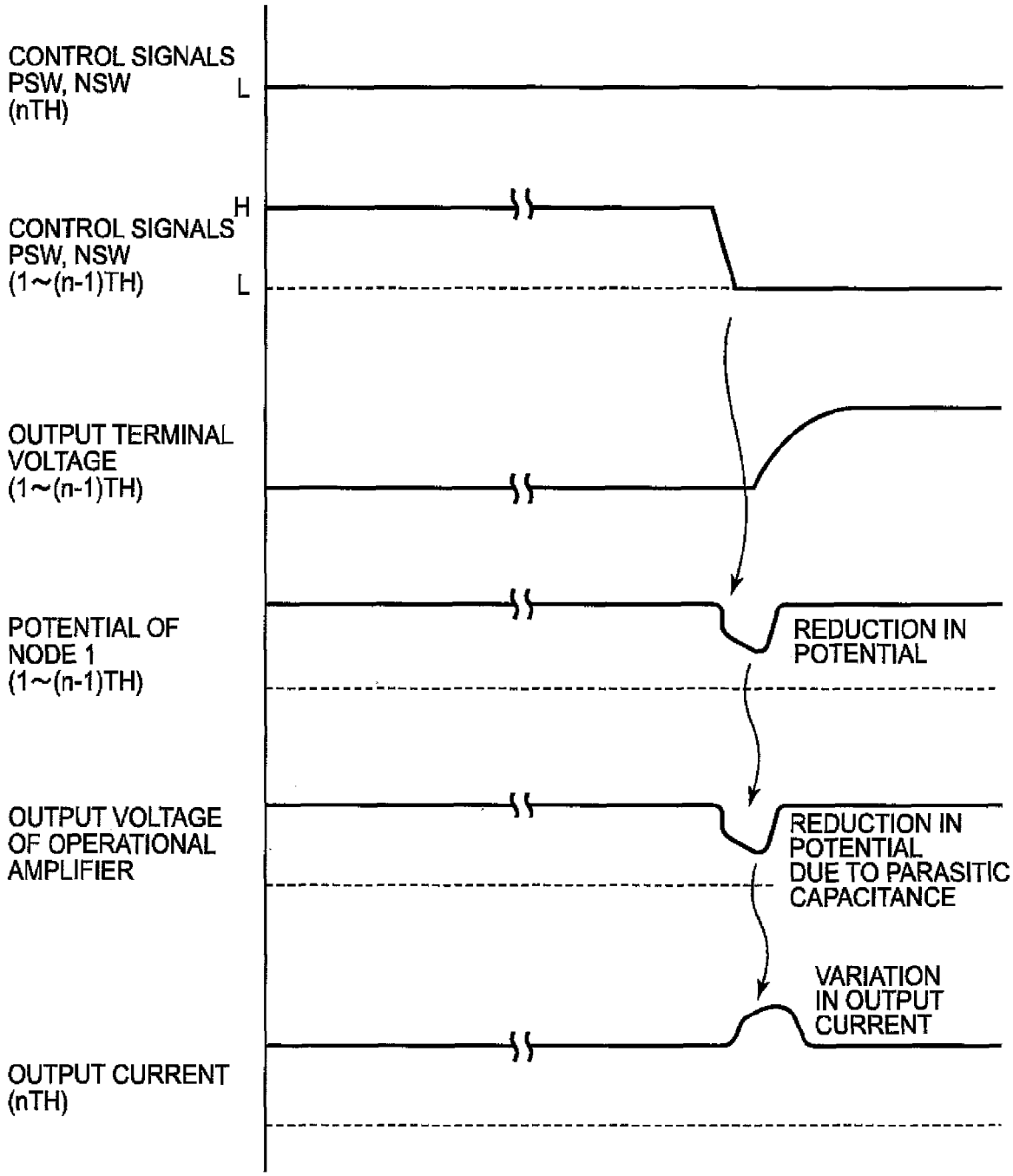
FIG. 6 is a diagram illustrating operation waveforms of the current source device of the present invention.
Figure 8:
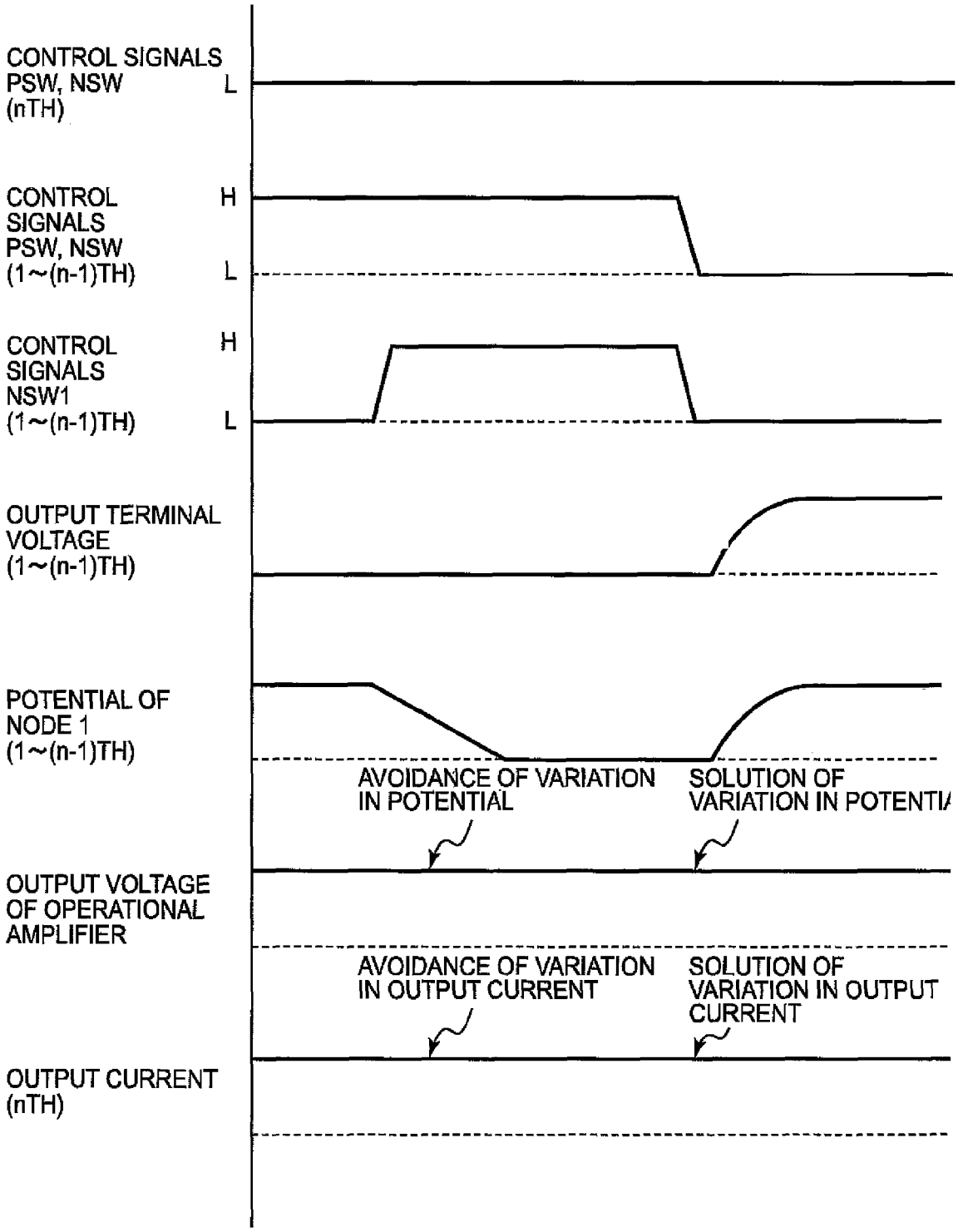
FIG. 8 is a diagram illustrating operation waveforms of the current source device according to the second preferred embodiment of the present invention.

The operation of the current source device 200 having such a configuration will be explained with reference to operation waveforms of respective parts thereof, which are shown in FIG. 8. In a manner similar to the case shown in FIG. 6, FIG. 8 shows the operation waveforms of the respective parts at the time that the nth current output circuit 70-*n* is caused to perform the supply of output current continuously, and the 1st through n−1th current output circuits other than the nth current output circuit are transitioned from a current supply stop state to a current supply state. In this case, control signals PSW and NSW are both switched from a High level to a Low level with the timing provided to start the current supply at the 1st through n−1th current output circuits. On the other hand, the control signals PWS and NSW are maintained at the Low level at the nth current output circuit 70-*n* to maintain the current supply. The gates of the NMOS transistors N11 of the 1st through n−1th current output circuits are respectively supplied with control signals NSW1 each having a High level within a period prior to the start of the current supply by these current output circuits, i.e., with the timing prior to the switching of the control signals PSW and NSW from the High level to the Low level. Thus, each of the NMOS transistors N11 is brought to an ON state so that the potential at the node 1 is reduced. Since, however, the switching speed of each NMOS transistor is sufficiently slower than that of each NMOS transistor N1 as descried above, the potential of the node N1 is slowly reduced. As a result, since the charge into each parasitic capacitance C1 occurs slowly, a reduction in the voltage of an output line of an operational amplifier OP1 is canceled out by the drive capacity of the operational amplifier OP1. That is, a variation in the potential of the output line of the operational amplifier OP1, which is caused by ON driving of each NMOS transistor N11, is avoided by making the switching speed of the NMOS transistor N11 slow. The NMOS transistor N11 is driven to an ON state so that the potential of the node 1 is fixed to a Low level. At the 1st through n−1th current output circuits, the control signals PSW, NSW and NSW1 are respectively switched from the High level to the Low level after the potential of the node 1 has been brought to the Low level. Thus, the PMOS transistors P3 and P11 are respectively brought to an ON state, and the NMOS transistors N1 and N11 are respectively brought to an OFF state. Since, however, the instant reduction in the potential of the node 1 does not occur even when each of the PMOS transistors P11 is brought to the ON state from the state in which the potential of the node 1 has been brought to the Low level, no charge into each parasitic capacitance C1 occurs, so that the variation in the voltage of the output line of the operational amplifier OP1 does not occur either. Accordingly, the nth current output circuit to maintain the current supply is capable of supplying a stable output current to each data line over prior and subsequent to the output switching by the other current output circuits.

Thus, according to the current source device related to the second preferred embodiment, variations in output currents, which occur in current output circuits to maintain the current supply with the timings provided to perform output switching by the large number of current output circuits, can be prevented in both of an operation mode in which the large number of current output circuits are transitioned from the current supply state to the current supply stop state and the current output circuits other than those maintain the current supply, and an operation mode in which the large number of current output circuits are transitioned from the current supply stop state to the current supply state and the current output circuits other than those maintain the current supply. Thus, the use of the current source device of the present invention as a current source for supplying light-emission drive currents to organic EL elements connected to a plurality of data lines via the data lines respectively corresponding to current output circuits makes it possible to supply stable light-emission drive currents to the organic EL elements regardless of the operation modes and attain the stabilization of light-emission luminance.

Third Preferred Embodiment

Figure 9:
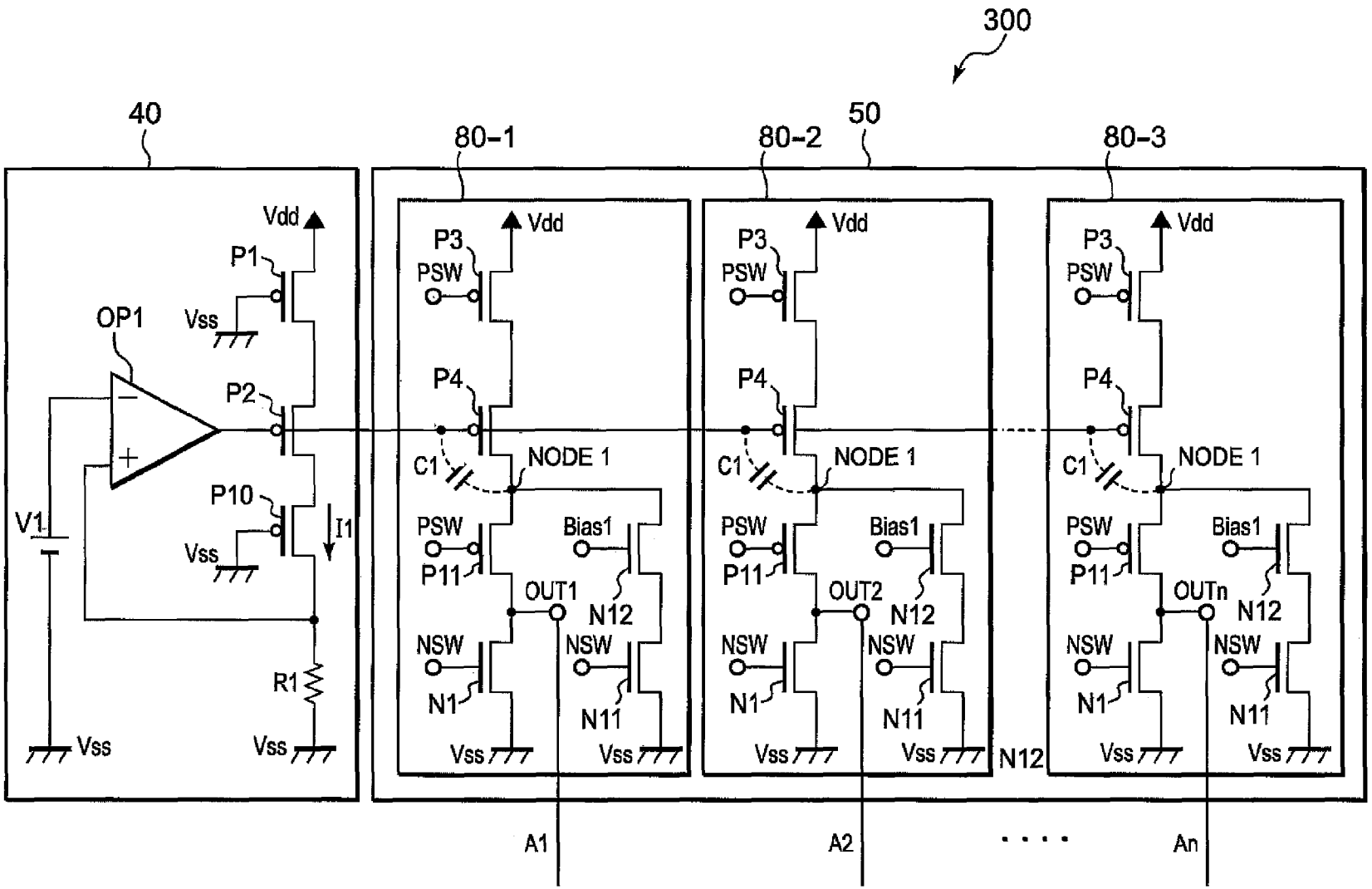
FIG. 9 is an equivalent circuit diagram showing a configuration of a current source device according to a third preferred embodiment of the present invention.

FIG. 9 shows an equivalent circuit diagram of a current source device 300 according to a third preferred embodiment of the present invention. While the current source device 300 according to the present embodiment is identical to that according to the second preferred embodiment in basic configuration, current output circuits 80-1 through **80-*n* are slightly different in configuration from that of the second preferred embodiment. Namely, the current output circuits 80-1 through 80-*n* according to the present embodiment include NMOS transistors N12 further added to the current output circuits according to the second preferred embodiment. Described specifically, the drain of each NMOS transistor N12 is connected to the drain of a PMOS transistor P4, i.e., a node 1, the source thereof is connected to the drain of an NMOS transistor N11, and the gate thereof is supplied with a gate bias voltage Bias1 from outside. The gate bias voltage Bias1 is set to a potential slightly higher than the threshold voltage of the NMSO transistor N12. Thus, while the NMOS transistor N12 is brought to an ON state, it has an on resistance corresponding to the gate bias voltage Bias1. That is, the NMOS transistor N12 functions as a resistive element connected in series to the NMOS transistor N11**.

The current source device 300 according to the present embodiment is similar to that according to the second preferred embodiment in operation. Since, however, the NMOS transistors N12 are added thereto and function as the resistive elements, the speed of pulling of an electric charge at the time each NMOS transistor N11 is ON-driven, is further reduced. Thus, the speed of a reduction in the potential of the node 1 can be more reduced, thereby making it possible to promote the effect of suppressing the instantaneous charge into each parasitic capacitor C1 at the time that each NMOS transistor N11 is ON-driven. That is, according to the current source device of the present embodiment, the effect of suppressing a variation in the potential of an output line of an operational amplifier OP1 when each NMOS transistor N11 is ON-driven can be made noticeable.

Figure 10:
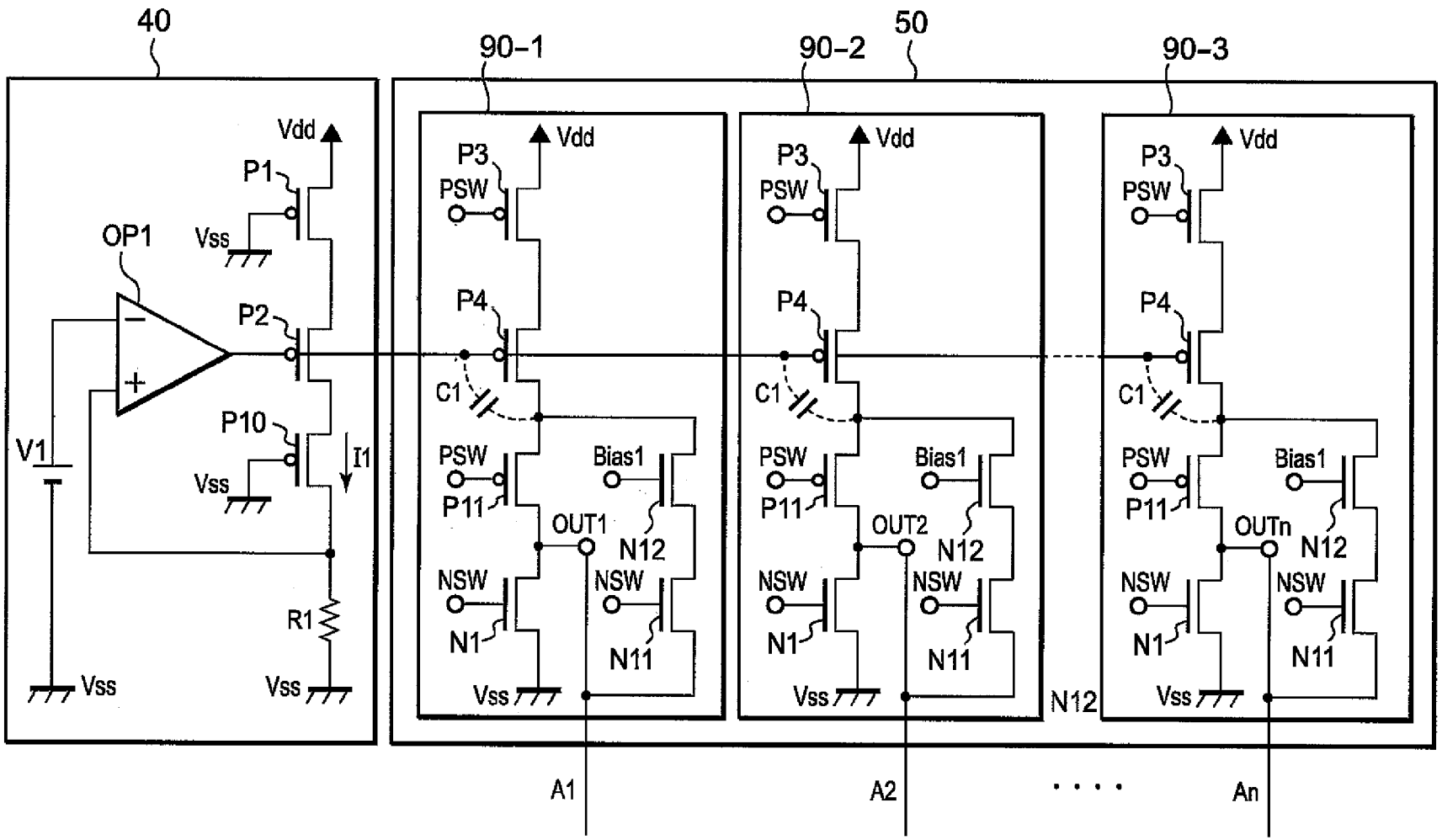
FIG. 10 is an equivalent circuit diagram showing a configuration of a current source device according to another preferred embodiment of the present invention.

Incidentally, similar effects can be obtained even though the resistors are used in place of the NMOS transistors N12. Similar effects can be obtained even though the NMOS transistors N12 and N11 are interchanged in position. Similar effects can be obtained even though the spot of pulling of charge by each NMOS transistor N11 is of a connecting point (i.e., the source of PMOS transistor P4) of the PMOS transistors P3 and P4. Although the electric charge of the node 1 is slowly pulled using each NMOS transistor N11 slow in switching speed in each of the embodiments, means for restricting the speed of pulling of charge at the node 1, i.e., pulling current may be constructed. Alternatively, other types of elements such as PMOSs and DMOSs may be used. As shown in FIG. 10, the sources of NMOS transistors N11 may be connected to their corresponding output terminals as shown in FIG. 10. Since the output terminal is of a Low level when each NMOS transistor N11 is ON-driven even in the case of such a connection configuration, no problem occurs in operation.

While the preferred forms of the present invention have been described, it is to be understood that modifications will be apparent to those skilled in the art without departing from the spirit of the invention. The scope of the invention is to be determined solely by the following claims.

What is claimed is:

1. A current source device comprising:

a plurality of current output circuits each including a current output FET, first and second switch FETs respectively series-connected to source and drain sides of the current output FET to form a series circuit, source voltage supply means which applies a positive-side potential of a source voltage to the first switch FET and applies a negative-side potential of the source voltage to the second switch FET to supply the source voltage to the series circuit, and an output terminal connected between the current output FET and the second switch FET; and a gate voltage supply circuit which supplies a common gate voltage to the gates of the current output FETs, wherein each of the current output circuits further includes a third switch FET provided between the current output FET and the second switch FET, and a potential fixing FET connected in parallel to a series circuit including the second and third switch FETs, and wherein switching time of the potential fixing FET is slower than switching time of the second switch FET.

2. The current source device according to claim 1, further including resistive elements respectively connected in series to the potential fixing FETs.

3. The current source device according to claim 2, wherein the first and third switch FETs are PMOS transistors and the second switch FET is an NMOS transistor.

* * * * *